United States Patent [19]

Heap et al.

[11] 4,038,813

[45] Aug. 2, 1977

[54] SPINNING OF TWISTLESS YARNS BY WET DRAFTING

[75] Inventors: Sydney Allan Heap, Marple, England; Willem Jacobus Naarding, Stad Delden, Netherlands

[73] Assignee: International Institute for Cotton, England

[21] Appl. No.: 670,207

[22] Filed: Mar. 24, 1976

[30] Foreign Application Priority Data

Mar. 25, 1975 United Kingdom ..... 12331/75

[51] Int. Cl.[2] ..... D02G 3/40

[52] U.S. Cl. ..... 57/153; 57/164; 156/148; 156/166; 428/361; 428/378

[58] Field of Search ..... 57/140 C, 162, 164, 57/139, 153; 28/75 R, 76 R; 156/148, 166, 167, 180; 428/357, 360, 361, 375, 378, 392–396

[56] References Cited

U.S. PATENT DOCUMENTS

| | | | |
|---|---|---|---|
| 3,447,310 | 6/1969 | Bok et al. | 57/164 |
| 3,877,214 | 4/1975 | Van der Werf | 57/164 |
| 3,885,277 | 5/1975 | Schutz et al. | 57/164 X |

FOREIGN PATENT DOCUMENTS

| | | | |
|---|---|---|---|
| 144,679 | 4/1974 | Netherlands | 57/164 |

*Primary Examiner*—Richard C. Queisser
*Assistant Examiner*—Charles Gorenstein
*Attorney, Agent, or Firm*—Beveridge, De Grandi, Kline & Lunsford

[57] ABSTRACT

A continuous process for the spinning of twistless yarn from staple fibres which comprises the steps of:

a. drafting a sliver or roving containing not more than 80% by weight, based on the weight of fibre, of a liquid containing a dispersed potential binding agent as herein defined,
b. consolidating the drafted sliver or roving,
c. rendering the potential binding agent adhesive,
d. drying the yarn, and
e. winding the yarn.

The potential binding agent which may be starch, a starch derivative or a synthetic polymer dispersion may be rendered adhesive by dielectric heat, radiant heat, heated vapor or by polymerization or by breaking labile cross-links. The size of the particles of the potential binding agent is preferably not greater than the average fibre diameter.

15 Claims, No Drawings

SPINNING OF TWISTLESS YARNS BY WET DRAFTING

The present invention concerns improvements in and relating to the spinning of twistless yarns from staple fibres.

Because of the limitations on speed at which even the most modern spinning machines can produce acceptable yarns from staple fibres, such limitations being mainly due to the requirement for inserting twist into the yarn, research has been directed towards spinning systems which dispense with the insertion of twist, substituting the use of adhesives to impart the necessary cohesion between the fibres to obtain sufficient strength for subsequent processing of the yarns into fibrics.

Several systems for producing such adhesive-bonded twistless yarns have been described but they all suffer from one or more of the following disadvantages:

1. Excessive contamination of machine parts by sticky adhesive solution leading to difficulties in controlling the assembly of fibres and to excessive end-breakage rates.

2. Non-continuous processing whereby, for example, a package of still unbonded wet twistless yarn has to be wound at the spinning machine, the adhesive being activated and/or the package being dried in a subsequent process. Apart from the inherent drawback of needing a separate processing step, such a system suffers the serious disadvantages that it is difficult to piece up a broken end in a satisfactory way, and there is migration of the adhesive during the subsequent drying of the package. In addition such processes suffer from the limitations that it is necessary to wind a cross-wound package and there is a limitation to the size of the package which can be produced because of difficulties in the subsequent activation of adhesive and/or drying of the package.

3. The necessity for application of the adhesive solution to a strand which is already wet, such applications being difficult to control and therefore resulting in relatively large variations in the concentration of adhesive along the length of the final yarn.

4. The use of special fibres as potentially adhesive material blended into the feed sliver before spinning. Such fibres are difficult to control in respect of their thermoplastic or solubility characteristics, and small variations in such characteristics have a large influence upon the spinning speed which can be achieved, small variations in processing conditions leading to large variations in the properties of the final product. Furthermore, such special fibres are relatively expensive and the pre-blending operation is also relatively expensive and inconvenient to control adequately.

5. The application of large quantities of water which then have to be removed by a drying process, such drying process causing migration of the adhesive in proportion to the amount of water present and necessitating the consumption of large amounts of power and/or space, and/or necessitating a slow production speed. The amounts of water involved may be so large as to practically exclude continuous processing.

6. The use of water-soluble adhesives with which it is difficult to produce an impregnating liquor of the required properties, namely low viscosity at adequate solids content. The problems of water-soluble adhesives become greater the lower is the amount of liquor to be applied per unit weight of the fibre material, for a given solids add-on. For example, if it were desired to apply a typical water-soluble adhesive at the level of 10 percent by dry weight on the weight of fibre, and this was to be achieved by the application of 100 percent on the weight of fibre of a solution of the adhesive, then the concentration of adhesive in the solution would have to be 10 percent. At this level of concentration most water-soluble adhesives produce a rather viscous and sticky solution which is entirely unsuitable for the present purpose. At lower liquor application levels the problems are, of course, correspondingly much greater.

The present invention concerns a new procedure for the manufacture of twistless yarns from staple fibres whereby the disadvantages of the earlier methods may be avoided.

In particular the properties of the liquor containing potential binding agent are closely controlled and the amount of the liquor which is applied to the staple fibres is closely controlled at a minimal level so as to substantially eliminate migration of the binding agent and to enable a continuous drying operation to be conveniently deployed, but yet to retain the known advantages of wet drafting. Furthermore the present system is a continuous process which enables a dry, coherent yarn to be spun directly so that weak places are not generated by the winding-on procedure, piecing up of a broken end is conveniently carried out, and with this process there are no practical limitations to the size and type of yarn package which can be produced.

According to the present invention, therefore, a continuous process is provided which comprises the following steps:

1. drafting a silver or roving containing not more than 80% by weight, based on the weight of fibre, of a liquid containing a dispersed potential binding agent, as hereinafter defined,
2. consolidating the drafted sliver or roving,
3. rendering the potential binding agent adhesive,
4. drying the yarn, and
5. winding the yarn.

By "potential binding agent" we mean a material which does not form a film or sticky deposit when, after having been dispersed in said liquid, said liquid is evaporated at room temperature, but which can be rendered adhesive by physical or chemical means.

In Step 1, the liquid is preferably water but may be another liquid, for example white spirit or a chlorinated hydrocarbon. In order to minimise problems of machine contamination, and in order to obtain optimum control of the drafting operation it is important that the viscosity and the surface tension of the liquor, i.e. the liquid containing the dispersed potential binding agent, are such that rapid and effective penetration of the sliver or roving by the liquor takes place.

The viscosity of the liquor is preferably not greater than about 10 cp and more preferably is not greater than about 3 cp.

The surface tension of the liquor is preferably not greater than about 50 dyne/cm and more preferably is not greater than about 30 dyne/cm.

Furthermore, for the purposes of the present invention the liquor should not be a true solution but should consist of a dispersion of the potential binding agent in a medium such as, for example, water or white spirit, the size of the particles of binding agent being preferably not greater than the average fibre diameter and, more preferably, being not greater than about one tenth of the average fibre diameter. The use of particles having a size not greater than the average fibre diameter has the following advantages:

a. the smaller the particle size the easier it is to maintain a uniform dispersion,
b. the smaller the particle size the easier it is for the particles to penetrate between the fibres,
c. the smaller the particle size the greater the number of potential binding points for a given weight of binder and
d. particles having a size significantly greater than the average fibre diameter will tend to disrupt the drafting process by reducing the grip of the drafting rollers on the fibres. The combination of these advantages facilitates the smooth running of the process and the uniformity of the product.

As well as the binding agent and the liquid, the liquor may contain other substances such as, for example, surface active agents, to lower the surface tension of the liquor, or lubricants to improve the winding and further processing characteristics of the yarn, or plasticisers for the binding agent to improve the flexibility and extensibility of the final yarn. Suitable surface active agents are, for example, alkyl aryl sulphonates; suitable lubricants are, for example, polyethylene oxide long chain fatty acid esters, and suitable plasticisers are, for example, triethylene glycol or diethyl phthalate.

Examples of binding agents are starch, starch derivatives or synthetic polymer dispersions. The starch or starch derivative suitably has a particle size of less than 20 microns, and is e.g. rice starch, small granule classified wheat or potato starch or a derivative thereof. The gelatinization temperature of the starch or starch derivatives may have been lowered, e.g. by alkali or urea, for activation of the starch binding agent at lower temperatures.

The binding agent is preferably one which can be substantially completely removed from the yarn after it has been woven or knitted or otherwise formed into a fibric.

The impregnated sliver or roving may be prepared, for example, by immersing the sliver or roving in the liquor, followed by removal of any liquor in excess of the required amount or by applying the required amount directly to the sliver or roving. The optimum percentage by weight of the liquor contained in the sliver or roving during drafting will vary according to the properties of the potential binding agent, of the liquid, and of the fibres. Generally speaking, a lower application level would be used for non-absorbent fibres than for absorbent types. However, it is an important feature of the present invention that, for a given combination of liquor and fibre types, the application of the liquor containing the potential binding agent is controlled at a level which is the minimum required to give good drafting efficiency and an adequate final yarn strength. The level of application of the liquor is preferably within the range of 20 to 60 percent by weight based on the weight of fibre. This is substantially below the levels which have been advocated in previously described twistless spinning or wet drafting systems. Indeed, it is a surprising result of the present procedure that the drafting efficiency is much better in the presence of the liquor containing the dispersion of the potential binding agent than in the presence of water containing a wetting agent but without a dispersed potential binding agent present.

The level of addition of the binding agent is normally within the range of 4 to 15 percent by dry weight based on the weight of fibres.

The impregnated sliver or roving can be drafted at a speed significantly higher than is conveniently possible in conventional dry roller drafting process.

Drafting may be accomplished, for example, using a single zone roller drafting system or a multi-stage system may be used. In common with all wet drafting systems delivery speeds in excess of 50 meters/minute are achievable, such performance being not conventiently attainable with conventional ring spinning systems. However, previously described wet drafting systems have operated with a relatively large quantity of water present in the sliver or roving and brings some difficulties due to the excess water which is expressed at the drafting rollers and elsewhere in the machine. By reducing the level of liquor present in the sliver or roving as in the present invention, such difficulties are substantially avoided, but at the same time it is necessary to maintain a certain quantity of liquor between the fibres in order to ensure their coherence and thereby to ensure good regularity and reproducibility of the drafting operation. As mentioned above, this is one of the criteria governing the choice of the amount of liquor present during drafting in the present invention.

In Step 2, consolidation of the drafted sliver or roving may be accomplished by any of the known methods, for example, by compression in a confined space by rollers and side-plates, or by reciprocal rubbing, but the preferred method of consolidation is by false twisting with a fluid vortex since by this means one obtains the following benefits:

1. Efficient collection of the fibres as they emerge from the delivery rollers, thus reducing roller lapping.
2. Provision of a temporary strength for the drafted sliver or roving during the time before the adhesive bonds have been formed.
3. Evaporation of a proportion of the water or other liquid medium from the liquor in the drafted sliver or roving.
4. Consolidation of the drafted sliver or roving into a roughly circular cross-section, thus allowing for good fibre to fibre contact at the time when the adhesive bonds are being formed.
5. The provision of a low-tension, self-cleaning, non-contact guide, thus helping to maintain the stability of the spinning system with minimum interference at a point where the drafted sliver or roving is relatively weak and unsupported, whilst introducing a minimum of machine contamination.

In Step 3 the potential binding agent may be rendered adhesive, for example, by dielectric heat, radiant heat, heated vapour, or by polymerisation or breaking labile cross-links.

In Step 4, the drying may be carried out by any of the known methods for continuously drying and winding a moving yarn, such as for example heated chimneys, hot air blowers or infra-red radiation but the preferred method is an arrangement whereby a relatively large amount of yarn can be confined to a relatively small space for example on advancing rollers.

In Step 5, the winding unit may be any of the known types for winding on yarns at medium to high speeds, but it is advantageous if the winder is of the type in which variations in tension in the yarn are minimised since these can cause variations in the properties of the final yarn. In principle, however, there are no real limitations to the type or the size of yarn package which can be wound, and this is a considerable advantage over some of the previously-described twistless spinning systems.

Steps 2 and 3 can be carried out simultaneously by, for example, using a fluid in the false twisting vortex which is capable of rendering the potential binding agent adhesive, for example hot air or steam or by situating a false twisting spindle behind a dielectric heater.

Steps 3 and 4 may be combined for example the yarn may be wound several times around a pair of advancing rollers of about 60 millimeters diameter placed about 120 millimeters apart and along each side of the yarn path are placed heater plates which are close to, but not touching, the yarn. We have found that by wrapping about 30meters of yarn on the advancing rollers and maintaining the heater plates at about 170° C. a 24 Tex yarn having a water content of about 70 percent can be dried at a speed in excess of 70 meters/minute.

Steps 4 and 5 can be combined, for example, by blowing hot air on to the yarn or the package during winding.

EXAMPLE I

A 3000 Tex sliver of American Acala-type cotton was impregnated by means of a device which consisted of a shallow trough about 35 cm long and a pair of squeezing rollers. The lower roller was made of stainless steel and was flanged so that a channel with steeply sloping sides was formed around the circumference, the width of the channel being about 1 cm at its narrowest. This lower roller was positively driven. The upper roller was also made from stainless steel and rode in the channel of the lower roller with very little clearance at the narrowest part. However, this upper roller was also covered with a layer of absorbent material in the form of a layer of 3 mm thick wool felt covered by a smooth polyester woven fabric. The top roller was driven by frictional contact with the lower, and was provided with a weighting arm by which means the pressure between the two rollers could be varied. By this means the add-on of liquor to cottom sliver could be reproducibly controlled at any value between about 30% and about 100%, on the weight of dry fibre.

The impregnation liquor was contained in the shallow trough and consisted of the following ingredients in water:

400/g/liter binding agent dispersion 10 g/liter wetting agent

The wetting agent was Serwet WH 170, a sodium sulphosuccinic dioctyl ester manufactured by NV Chemische Fabriek Servo.

The binding agent was an aqueous dispersion of a styrene-acrylic copolymer having a solids contents of about 40% a particle size of about 1 micron and a minimum film-forming temperature of about 50° C.

The viscosity of the liquor was about 3 cp and its surface tension was about 27 dyne/cm.

The sliver was fed on the surface of the liquor in the trough at a speed of about 1 m/min and was drawn across the liquor by the squeezing rollers. The total contact time of the sliver and liquor was about 20 seconds and since the sinking time of the sliver in this liquor was about 10 seconds, there was adequate time for thorough and uniform penetration of the sliver by the liquor.

The pressure at the squeezing rollers was adjusted so as to result in an add-on of about 55% of liquor based on the weight of dry sliver.

From the squeezing rollers, the impregnated sliver passed to a three-zone drafting system. The drafting ratios were, successively, 4.34, 1,085 and 15.97 giving a total drafting of 75 times.

Thus, the delivery speed was about 75 m/min and the final yarn count was about 40 Tex.

From the front rollers of the drafting equipment, the strand passed to a pneumatic false twisting unit of appropriate bore, having its tangential air ports inclined at about 15° to the axis of the yarn, pointing in the direction of processing. This unit was driven with an air flow of about 24 liters per minute.

From the false twisting unit the yarn passed to a dryer unit consisting of a pair of advancing rolls of about 60 mm diameter placed about 120 mm apart, with a pair of heater plates which were close to, but not touching the yarn. The temperature of the heater plates was about 200° C. and about 30 m of yarn was wrapped around the advancing rolls.

During the drying the yarn temperature rose above the minimum film-forming temperature of the binding agent so that coherent fibre-fibre bonds were formed.

From the dryer unit the yarn was passed to a conventional friction-drum winding unit.

The final yarn was found to have a strength of about 7 g per Tex and an elongation at break of about 5%. Its uniformity as measured by the Uster U% method was about 16.0. The solids content of adhesive was found to be about 8% and it was found to be possible to fabricate the yarn into a knitted fabric without difficulty.

EXAMPLE II

A 4000 tex sliver of normal unbleached cotton was impregnated with an aqueous suspension of rice starch by means of the device described in Example I.

The fibers in the sliver had a diameter varying from 7–25 micron. The aqueous suspension contained 100 g/liter of rice starch having an average particle size of 4–5 micron and 5 g/liter of sodium sulphosuccinic dioctyl ester (Serwet WH 170) as wetting agent. The suspension had a viscosity of 2.4 cp and a surface tension of 27.0 dynes/cm. In order to prevent sedimentation of the rice starch in the trough the suspension was agitated by circulating by a pump. The pressure at the squeezing rollers was adjusted so as to give an add-on of about 75% of suspension based on the weight of the dry sliver.

The impregnated sliver was drafted with the three-zone drafting system and passed through the pneumatic false twisting unit as described in Example I. The delivery speed was about 40 m/min. After false twisting the yarn passed through a steam chamber to activate the starch adhesive. The chamber, into which saturated steam was fed, contained a pair of advancing rolls of 250 mm diameter placed at a distance of 400 mm from axis to axis. About 80 m of yarn was wrapped around the advancing rolls After the steam chamber the advancing yarn was dried in a stream of hot air and wound on a conventional winding unit. The yarn so obtained has a yarn count of about 50 tex, a strength of 9g per tex and an elongation at break of about 3%.

The final yarn contained 9% adhesive based on the weight of the yarn. The yarn could easily be woven to a fabric.

EXAMPLE III 4000 tex slivers of normal unbleached cotton were impregnated with various aqueous suspensions of size-classified starches by means of the device described in Example II. Two sizes of starch were used, wheat starch with an average particle size of 5 micron and potato starch with an average particle size of 14–18 micron. These small-granule starch products were obtained by pumping a suspension of wheat- or potato starch through a series of hydrocyclone separators e.g. as described in U.S. Pat. No. 2,642,185. The slivers, which consisted of fibres with average diameter varying from 7–25 microns, were impregnated with the following suspensions:

| | starch type. | concentration. | particle size. | viscosity. | surface tension. |
|---|---|---|---|---|---|
| a/ | wheat starch | 5% by weight | 5 microns | 1.4 cp | 27.1 dynes/cm |
| b/ | wheat starch | 10% by weight | 5 microns | 1.7 cp | 27.0 dynes/cm |
| c/ | potato starch | 5% by weight | 14–18 microns | 1.5 cp | 27.1 dynes/cm |
| d/ | potato starch | 10% by weight | 14–18 microns | 2.4 cp | 27.0 dynes/cm |

All suspensions contained 5 g/liter of sodium sulphosuccinic dioctyl ester (Serwet WH 170) as wetting agent. The pressure at the squeezing rolls of the impregnating device was adjusted so as to give an add-on of 75% of suspension based on the weight of the dry sliver. The steps of drafting and false twisting were carried out as described in Example II.

The delivery speed was 40 m/min. The activation of the starch adhesive took place in the steam chamber as described in Example II. After activation the yarn was dried on the dryer unit as given in Example I. The temperature of the heater plates was about 150° and about 15 m of yarn was wrapped around the advancing rolls.

The yarns obtained with the adhesive suspension a/, b/, c/ or d/ had the following characteristics:

| | strength. | elongation at break. | starch content. | yarn count. |
|---|---|---|---|---|
| a/ | 6 g/tex | 3 % | 5 % | 50 tex |
| b/ | 8 g/tex | 3 % | 11 % | 50 tex |
| c/ | 7 g/tex | 3 % | 12 % | 50 tex |
| d/ | 9 g/tex | 3 % | 16 % | 50 tex |

The yarn could easily be manufactured into a fabric.

The binders were removed from the fabric by enzymatic desizing.

EXAMPLE IV

A 400 tex sliver of polyester-cotton was impregnated with an aqueous suspension of a copolymer of methacrylic acid 10 % by weight and methyl methacrylate 90 % by weight, prepared by emulsion polymerization.

The suspension contained 12.5 by weight of the copolymer. The average particle size was 0.5 micron. A quantity of 5 g/liter of sodium sulphosuccinic dioctyl ester (Serwet WH 170) was added as wetting agent. The viscosity of the suspension was 5 cp and the surface tension 27.0 dyne/cm.

The impregnation was performed a described in Example I. By adjusting the pressure at the squeezing rollers and add-on of 75 % by weight was obtained.

The steps of drafting, false twisting and drying were carried out as described in Example I.

The delivery speed was 40 m/min.

The yarn so obtained had a strength of 7 g/tex, an elongation at break of about 3 % and a yarn count of about 50 tex. The final yarn contained 9.5 % adhesive based on the weight of the yarn.

The yarn was woven into a fabric from which the copolymer adhesive could easily be removed by washing with hot dilute alkali.

We claim:

1. A continuous process for the spinning of twistless yarn from staple fibres which comprises the steps of:

a. drafting a sliver or roving containing not more than 80% by weight, based on the weight of fibre, of a liquid containing a dispersed potential binding agent, said liquid containing a dispersed potential binding agent having a surface tension no greater than about 50 dyne/cm and a viscosity no greater than about 10 cp, the size of the particles of the potential binding agent being no greater than the average fibre diameter, b. consolidating the drafted sliver or roving, c. rendering the potential binding agent adhesive, d. drying the yarn, and e. winding the yarn.

2. A process as claimed in claim 1 in which the liquid is water.

3. A process as claimed in claim 1 in which the viscosity is not greater than about 3 cp.

4. A process as claimed in claim 1 in which the surface tension is not greater than about 30 dyne/cm.

5. A process a claimed in claim 1 in which the size of the particles is not greater than about one tenth of the average fibre diameter.

6. A process as claimed in claim 1 in which the binding agent is substantially completely removable from the yarn after it has been formed into fabric.

7. A process as claimed in claim 1 in which the binding agent is starch, a starch derivative or a synthetic polymer dispersion.

8. A process as claimed in claim 7 in which the starch or starch derivative has a particle size of less than 20 microns.

9. A process as claimed in claim 1 in which the sliver or roving contains 20 to 60% by weight, based on the weight of the fibre, of the liquid containing the potential binding agent.

10. A process as claimed in claim 1 in which the sliver or roving is of unbleached cotton.

11. A process as claimed in claim 1 in which the sliver or roving contains 4 to 15% by dry weight of binding agent based on the weight of the fibres.

12. A process as claimed in claim 1 in which the consolidation is effected by false twisting with a fluid vortex.

13. A process as claimed in claim 1 in which the potential binding agent is rendered adhesive by dielectric heat, radiant head, heated vapour or by polymerisation or by breaking labile cross-links.

14. A process as claimed in claim 1 in which the drying is effected on advancing rollers.

15. Twistless yarn whenever made by a process as claimed in claim 1.

* * * * *